US008840529B2

(12) United States Patent
Chen

(10) Patent No.: US 8,840,529 B2
(45) Date of Patent: Sep. 23, 2014

(54) ADJUSTABLE ELLIPTICAL TRAINER

(76) Inventor: Yi-Tzu Chen, Bade (TW)

( * ) Notice: Subject to any disclaimer, the term of this patent is extended or adjusted under 35 U.S.C. 154(b) by 317 days.

(21) Appl. No.: 13/420,005

(22) Filed: Mar. 14, 2012

(65) Prior Publication Data

US 2013/0244837 A1 Sep. 19, 2013

(51) Int. Cl.
*A63B 22/04* (2006.01)
*A63B 22/00* (2006.01)

(52) U.S. Cl.
USPC ..... 482/52; 482/62

(58) Field of Classification Search
CPC ..... A63B 22/001; A63B 22/0664; A63B 21/225; A63B 22/0605; A63B 22/0015
USPC ..... 482/51–52, 57, 62, 79–80
See application file for complete search history.

(56) References Cited

U.S. PATENT DOCUMENTS 3,432,164 A * 3/1969 Deeks ..... 482/51
5,836,855 A * 11/1998 Eschenbach ..... 482/57
6,361,476 B1 * 3/2002 Eschenbach ..... 482/52
7,435,204 B2 * 10/2008 Wu et al. ..... 482/52
7,611,446 B2 * 11/2009 Chuang et al. ..... 482/52
7,740,564 B2 * 6/2010 Shen ..... 482/52
7,780,580 B2 * 8/2010 Eschenbach ..... 482/62
7,993,247 B1 * 8/2011 Eschenbach ..... 482/52
8,465,398 B2 * 6/2013 Lee et al. ..... 482/52
2008/0161165 A1 * 7/2008 Wang ..... 482/52
2008/0261778 A1 * 10/2008 Chuang et al. ..... 482/52
2013/0035212 A1 * 2/2013 Chuang et al. ..... 482/52

* cited by examiner

*Primary Examiner* — Stephen Crow
(74) *Attorney, Agent, or Firm* — Abraham Hershkovitz; Hershkovitz & Associates, PLLC

(57) ABSTRACT

An adjustable elliptical trainer has a base, two driving brackets, two handles, two pedal assemblies and an adjustment assembly. The base has a transmission wheel mounted rotatably thereon. The driving brackets are connected respectively to the transmission wheel. The handles are connected pivotally and respectively to the driving brackets. The pedal assemblies are mounted at opposite sides of the transmission wheels. The adjustment assembly is mounted on the front end of the base and has two guiding rods and a guiding bracket. The guiding rods are mounted on the base. The guiding bracket is connected to the transmission wheel and mounted slidably on the guiding rods. The adjustment assembly allows the pedal assemblies to move along two different elliptical motion paths.

6 Claims, 9 Drawing Sheets

ADJUSTABLE ELLIPTICAL TRAINER

BACKGROUND OF THE INVENTION

1. Field of the Invention

The present invention relates to a trainer, and more particularly to an adjustable elliptical trainer that employs an adjustment assembly to allow pedals to move according to different motion paths.

2. Description of Related Art

A marketable conventional elliptical trainer comprises a base, a frame, a transmission wheel, two handles and two pedals. The frame is mounted on the base. The transmission wheel is mounted rotatably on the frame. The handles are mounted respectively on two opposite sides of the frame and each handle has a handlebar. The pedals are mounted respectively on the sides of the frame and each pedal has a shaft. One end of the handlebar or shaft on one side of the frame is connected to the transmission wheel through a link assembly and the other end of the handlebar or shaft is grabbed or stepped on by a user's hand or foot. When the user exercises on the elliptical trainer, his/her arms move back and forth and feet move up and down. The motion path of arms or foot is an ellipse.

However, because a pivot between the link assembly and the handle and a pivot between the link assembly and the pedal of the conventional elliptical trainer are stationary instead of being changeable, the motion paths of the handle and pedals are constant without any variations. Therefore, after repeatedly using the elliptical trainer, the user feels bored and becomes seldom using the elliptical trainer.

To overcome the shortcomings, the present invention provides an adjustable elliptical trainer to mitigate or obviate the aforementioned problems.

SUMMARY OF THE INVENTION

The main objective of the invention is to provide an adjustable elliptical trainer that employs an adjustment assembly to allow pedals to move according to different motion paths.

An adjustable elliptical trainer in accordance with the present invention has a base, two driving brackets, two handles, two pedal assemblies and an adjustment assembly. The base has a transmission wheel mounted rotatably thereon. The driving brackets are connected respectively to the transmission wheel. The handles are connected pivotally and respectively to the driving brackets. The pedal assemblies are mounted at opposite sides of the transmission wheels. The adjustment assembly is mounted on the front end of the base and has two guiding rods and a guiding bracket. The guiding rods are mounted on the base. The guiding bracket is connected to the transmission wheel and mounted slidably on the guiding rods. The adjustment assembly allows the pedal assemblies to move along two different elliptical motion paths.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
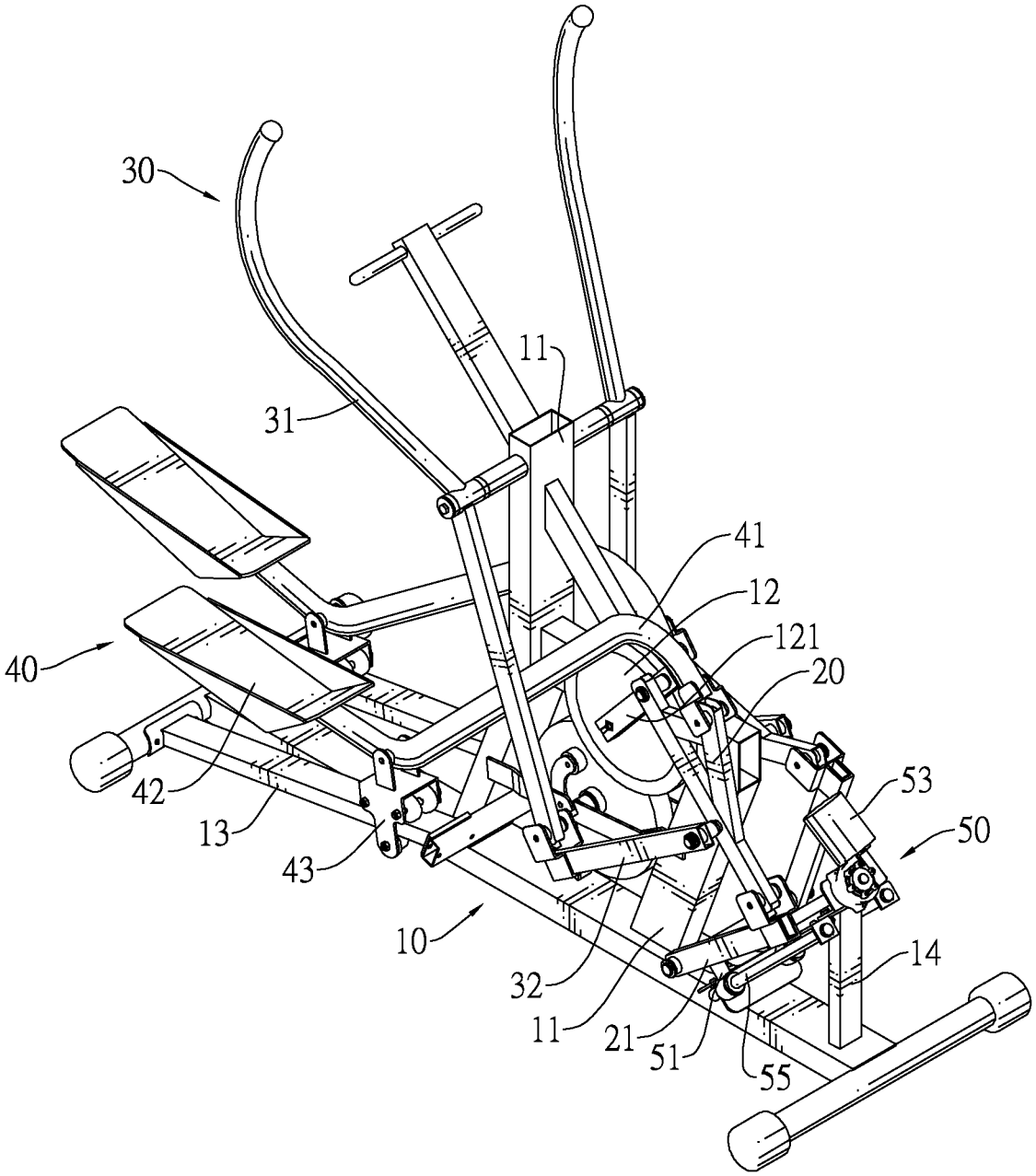
FIG. 1 is a perspective view of an adjustable elliptical trainer in accordance with the present invention.
Figure 2:
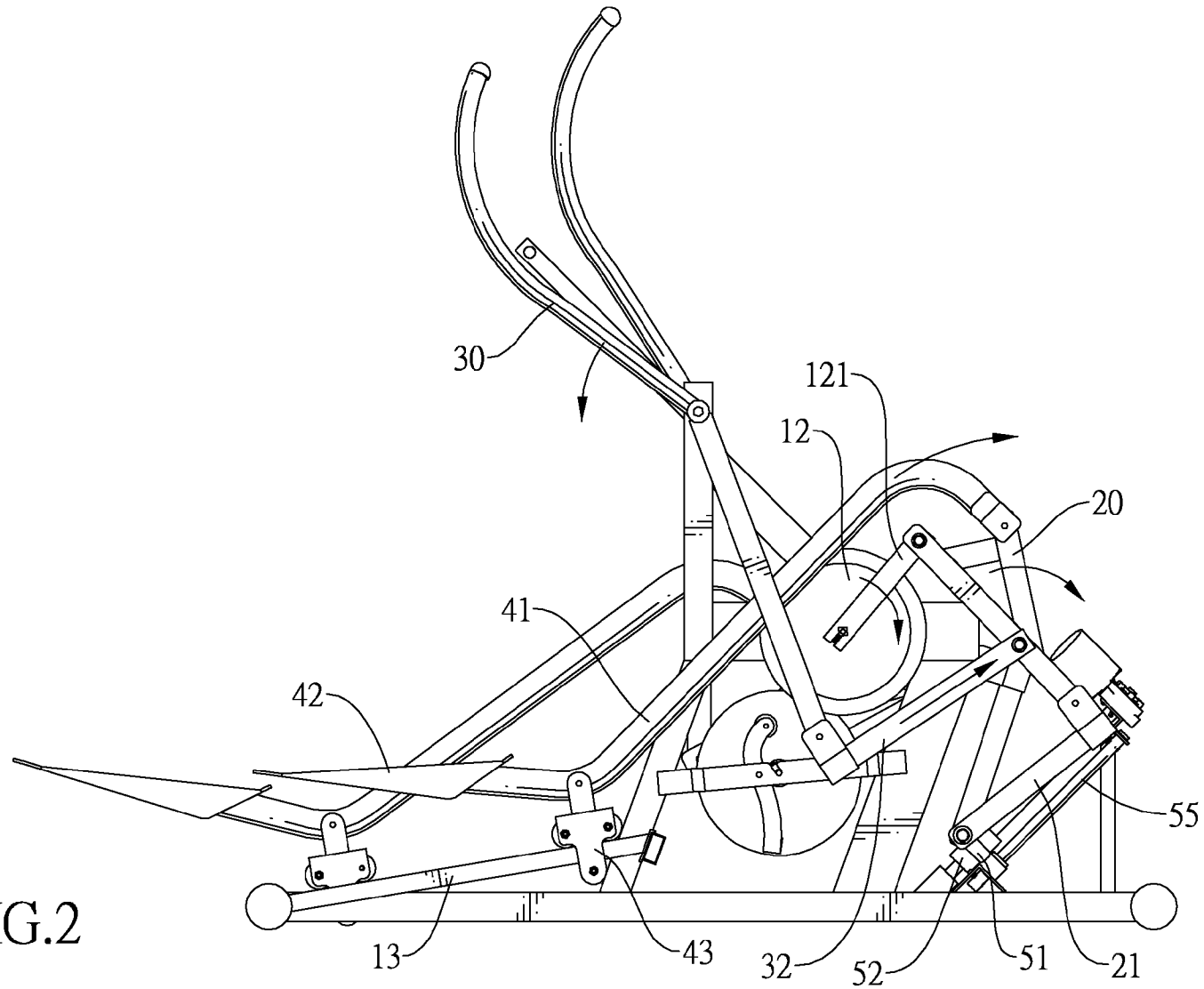
FIG. 2 is a side view of the adjustable elliptical trainer in FIG. 1 showing that a guiding bracket is located at a lower position.
Figure 3:
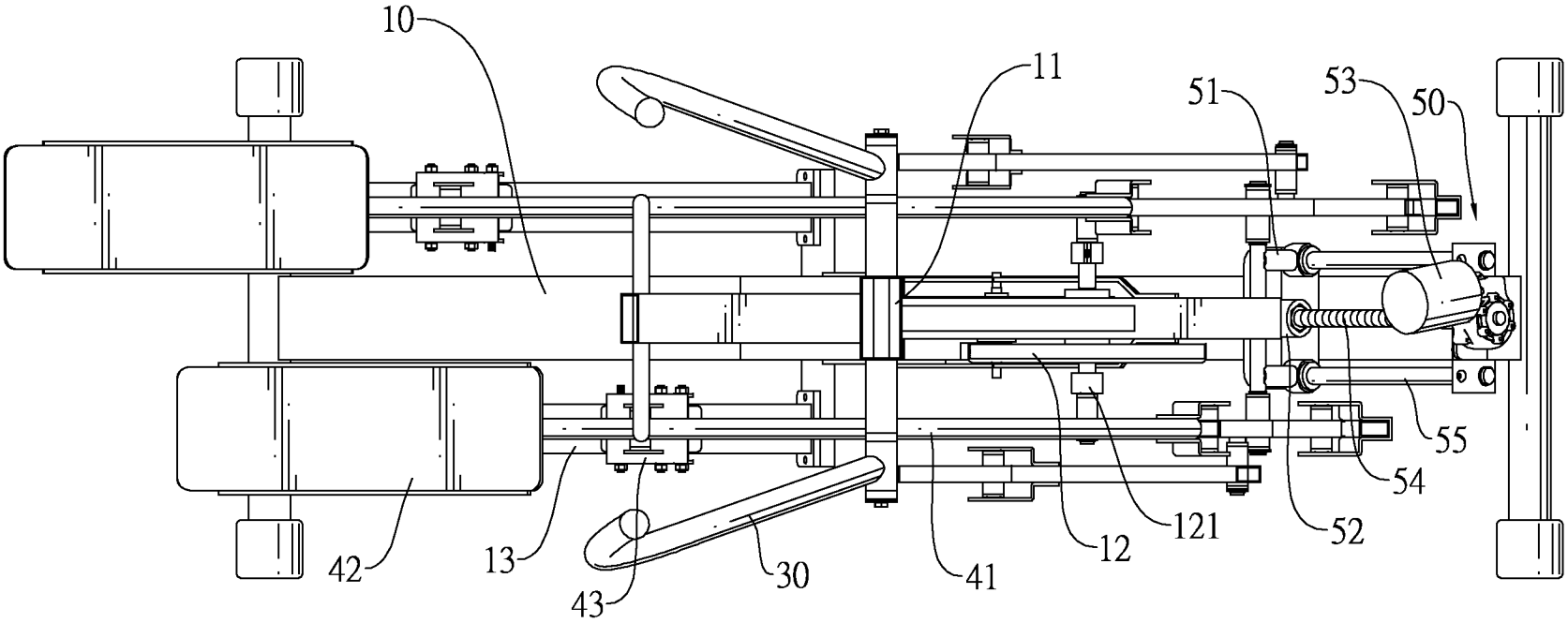
FIG. 3 is a top view of the adjustable elliptical trainer in FIG. 1.

With reference to FIGS. 1 to 3, an adjustable elliptical trainer in accordance with the present invention comprises a base 10, two driving brackets 20, two handles 30, two pedal assemblies 40 and an adjustment assembly 50.

The base 10 has two supporting bars 11, a transmission wheel 12, two rail bars 13, a front bar 14, an upper bracket 15 and a lower bracket 16.

The supporting bars 11 protrude up from the base 10.

The transmission wheel 12 is mounted rotatably between the supporting bars 11 and has a shaft and two cranks 121. The shaft is mounted through the transmission wheels 12. The cranks 121 are mounted respectively and securely on two ends of the shaft and extend along opposite directions.

The rail bars 13 are mounted obliquely on a rear end of the base 10.

The driving brackets 20 are connected respectively to the cranks 121 of the transmission wheel 12. Each driving bracket 20 may be a triangular bracket formed from multiple bars and has an adjusting bar 21.

The front bar 14 is mounted uprightly on a front end of the base 10.

The upper bracket 15 is mounted on a top end of the front bar 14 and has two through holes 151 defined through the upper bracket 15.

The lower bracket 16 is mounted on the base 10 behind the front bar 14 and has two mounting holes 161 defined through the lower bracket 16.

The handles 30 are located respectively at opposite sides of the transmission wheel 12, are mounted pivotally on one of the supporting bars 11 and are connected pivotally and respectively to the driving brackets 20. Each handle 30 has a handlebar 31. The handlebar 31 is longitudinal and has an intermediation section, a top end and a bottom end. The intermediation section is mounted pivotally on one of the supporting bars 11. The top end may be held by a user's hand. The bottom end is connected pivotally to a linking bar 32 that is connected pivotally to one of the driving brackets 20.

The pedal assemblies 40 are located at the opposite sides of the transmission wheels 12 and each pedal assembly 40 has a lever 41, a pedal 42 and a roller slide 43.

The lever 41 is curved and is connected pivotally to one of the driving brackets 20.

The pedal 42 is mounted on a rear end of the lever 41.

The roller slide 43 is mounted securely on the lever 41, is mounted slidably around one of the rail bars 13 of the base 10 and has multiple rollers mounted rotatably on the roller slide 43 and rolling on the rail bar 13.

Figure 4:
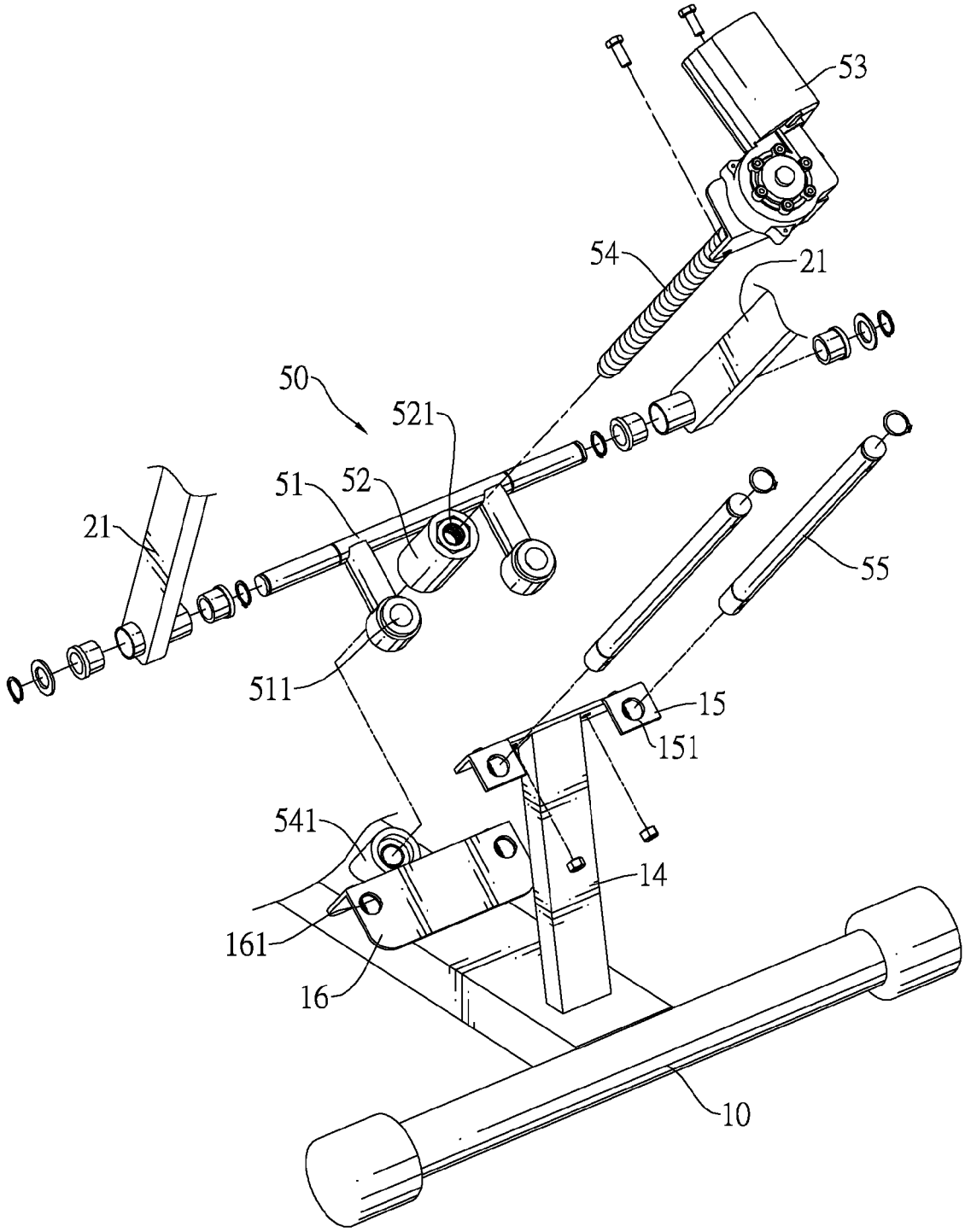
FIG. 4 is an exploded perspective view of an adjustment assembly of the adjustable elliptical trainer in FIG. 1.
Figure 5:
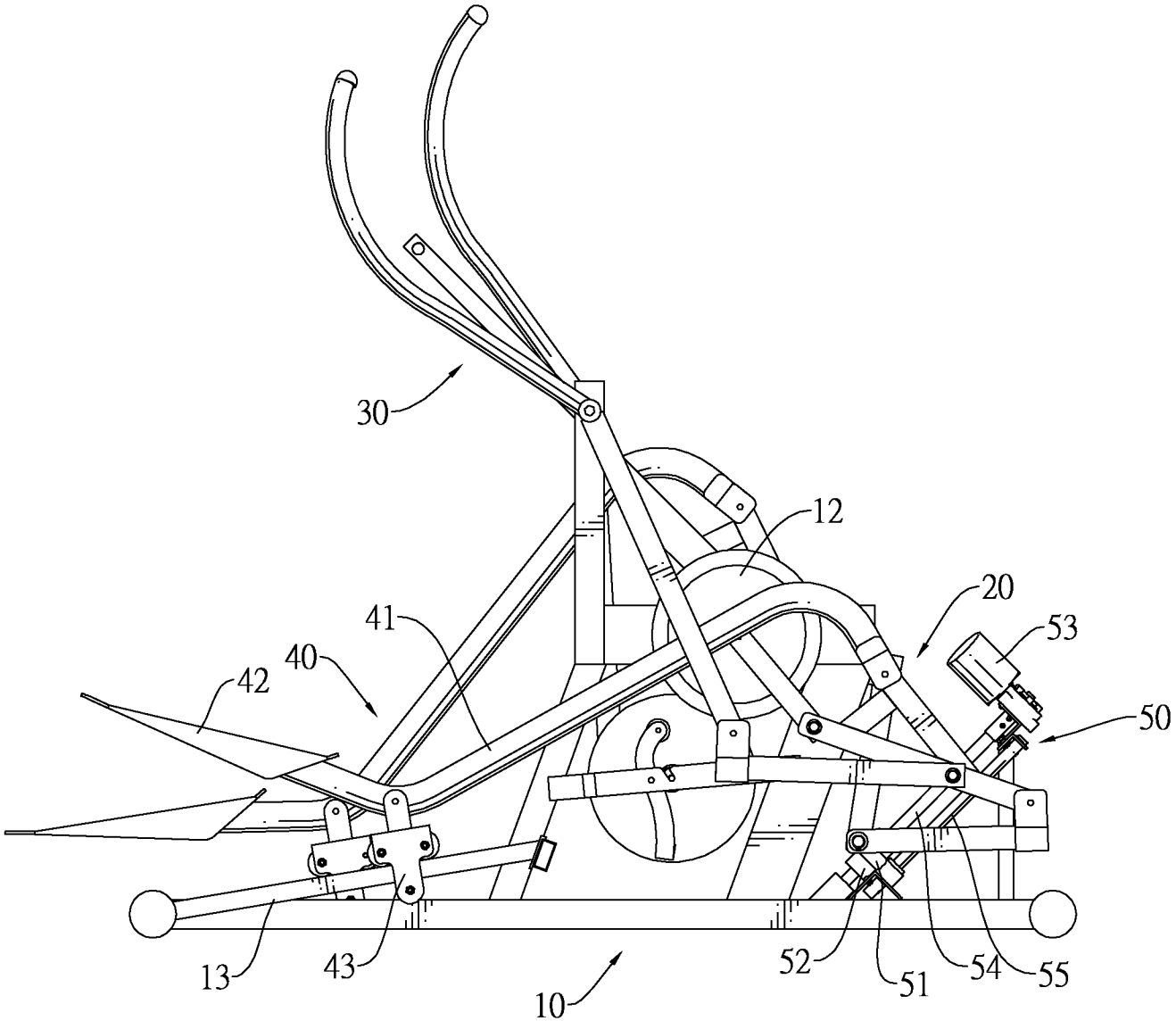
FIG. 5 is an operational side view of the adjustable elliptical trainer in FIG. 2.

With further reference to FIG. 4, the adjustment assembly 50 is mounted on the front end of the base 10 and has two guiding rods 55, a guiding bracket 51, a motor 53, a bolt 54 and a movable nut 52.

The guiding rods 55 are mounted on the base 10, may be mounted respectively through the through holes 151 of the upper bracket 15 and mounted respectively through the mounting holes 161 of the lower bracket 16.

The guiding bracket 51 is connected to the transmission wheel 12, may be mounted between the cranks 121, is mounted slidably on the guiding rods 55 and has two ends and two sleeves 511. The ends are mounted rotatably and respectively on the cranks 121. The sleeves 511 are formed on the guiding bracket 51 and are mounted slidably and respectively around the guiding rods 55. Each sleeve 511 has a sleeve hole defined therethrough.

The motor 53 may be a deceleration motor and is mounted securely on the upper bracket 15 of the base 10.

The bolt 54 is mounted on and rotated by the motor 53 and has an outer thread formed on the bolt 54. Furthermore, a positioning sleeve 541 is mounted on the base 10 and rotatably receives a bottom end of the bolt 54.

The movable nut 52 is mounted securely on the guiding bracket 51 and is mounted movably around the bolt 54. When the motor 53 is driven to rotate the bolt 54, the movable nut 52 and the guiding bracket 51 are driven to move up and down along the guiding rods 55. The movable nut 52 has an inner threaded hole 521 defined through the movable nut 52 and engaging the outer thread of the bolt 54.

Figure 6:
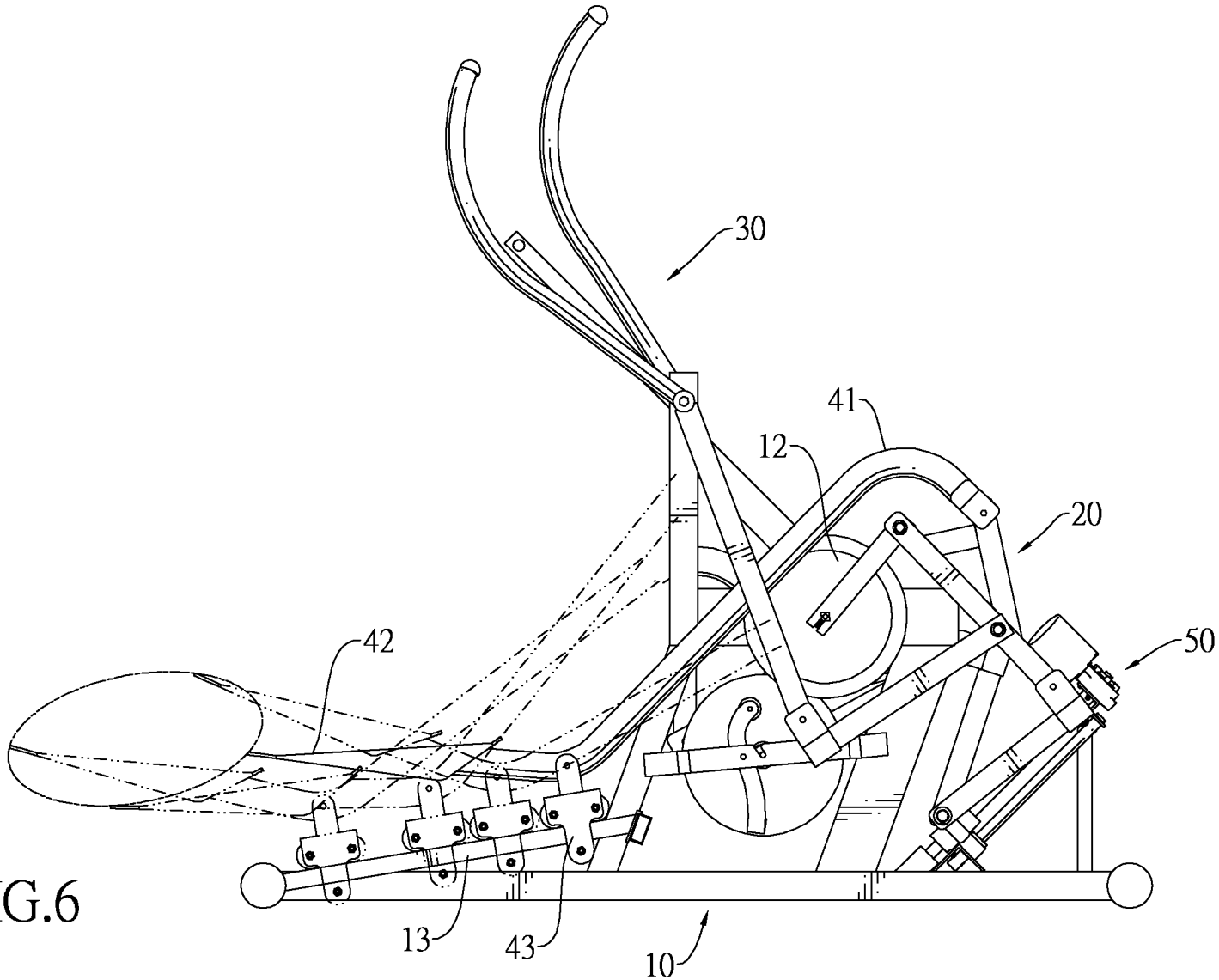
FIG. 6 is another operational side view of the adjustable elliptical trainer in FIG. 2 indicating an elliptical motion path of pedals.

With reference to FIGS. 2, 3, 5 and 6, when the adjustable elliptical trainer is used, the guiding bracket 51 and the movable nut 52 are moved down to a lower position through the control of the motor 53. The adjusting bars 21 are moved to lower ends of the guiding rods 55. A user grabs the handlebars 31 by hands, steps on the pedals 42 by feet and exercises on the adjustable elliptical trainer according to an elliptical motion path as shown in FIG. 6. When the user swings the handlebars 31 forth and back, the pedals 42 move along the elliptical motion path.

Figure 7:
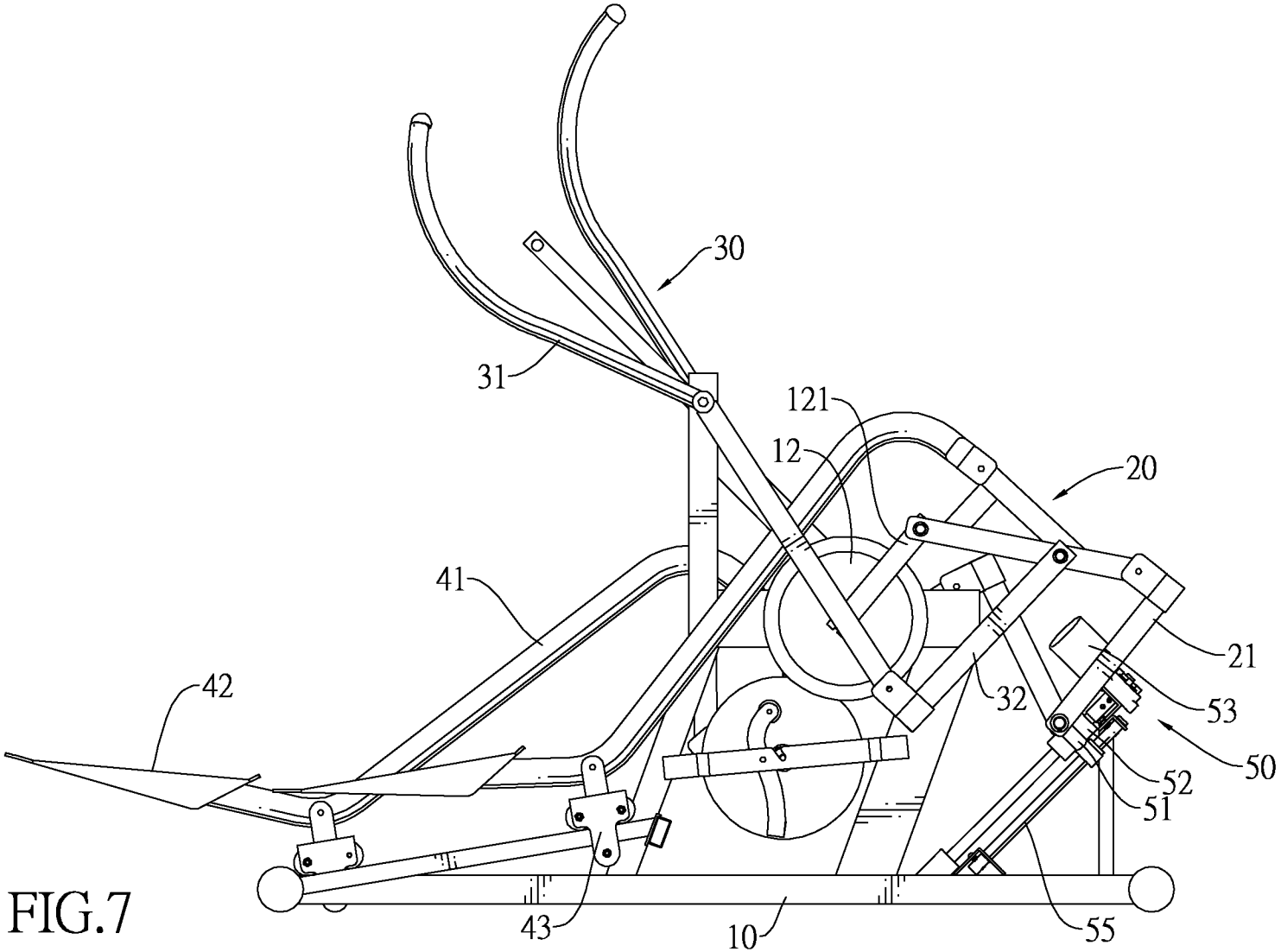
FIG. 7 is a side view of the adjustable elliptical trainer in FIG. 1 showing that a guiding bracket is located at an upper position.
Figure 8:
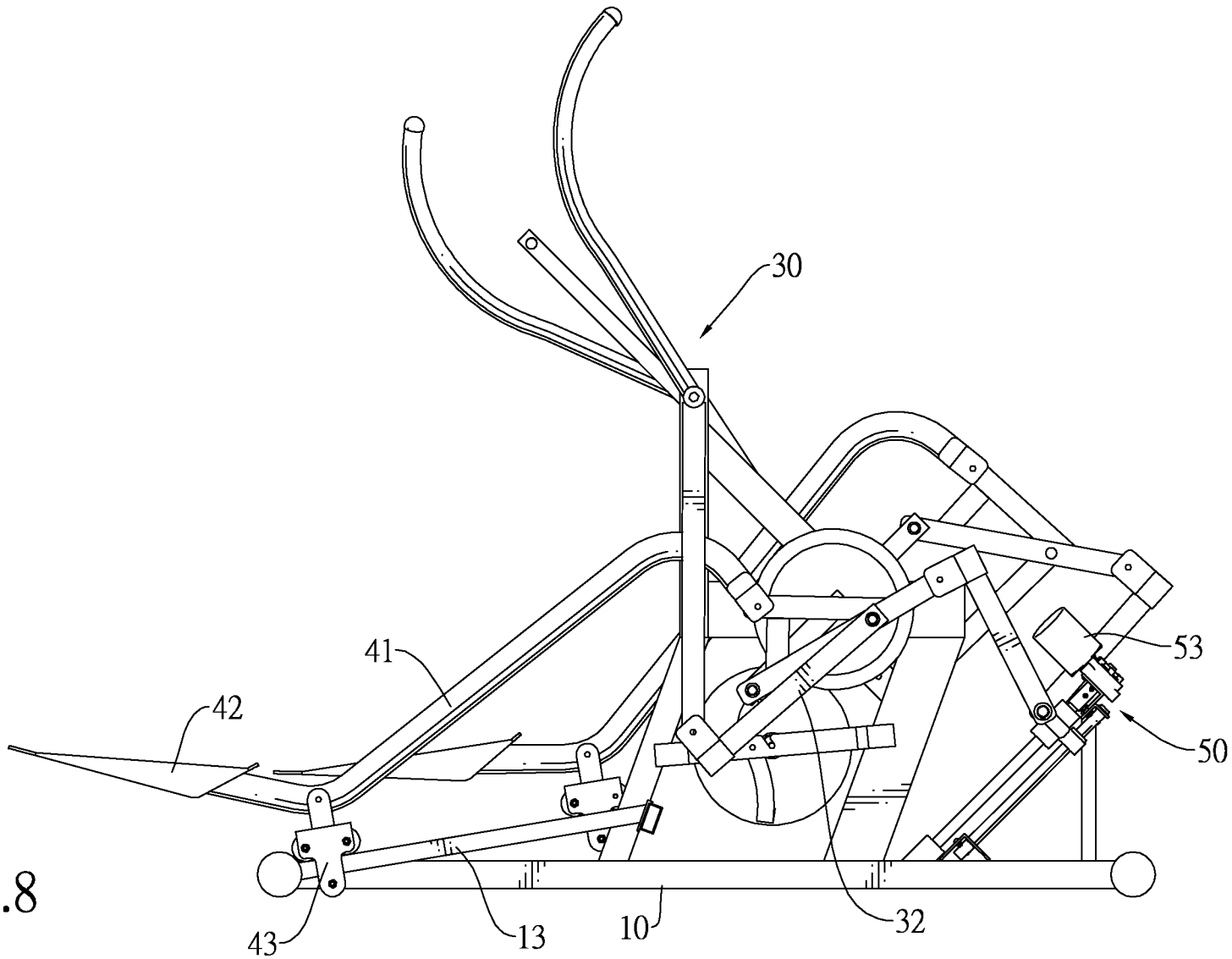
FIG. 8 is an operational side view of the adjustable elliptical trainer in FIG. 7.
Figure 9:
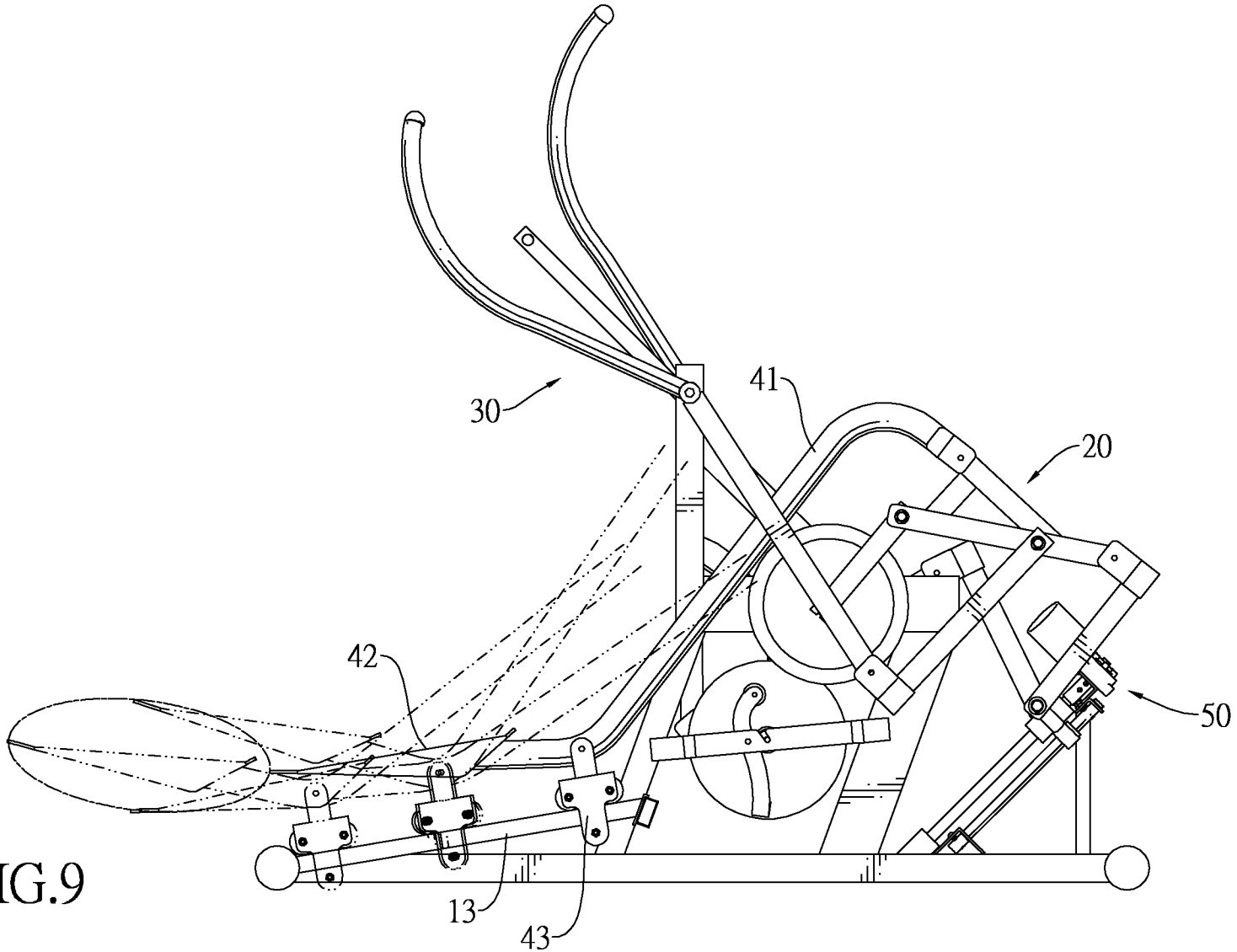
FIG. 9 is another operational side view of the adjustable elliptical trainer in FIG. 7 indicating another elliptical motion path of pedals.

With reference to FIGS. 7 to 9, the guiding bracket 51 and the movable nut 52 are moved up to an upper position through the control of the motor 53. The adjusting bars 21 are moved to upper ends of the guiding rods 55. The user exercises on the adjustable elliptical trainer according to another elliptical motion path as shown in FIG. 9. When the user swings the handlebars 31 forth and back, the pedals 42 move along the elliptical motion path.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable elliptical trainer comprising:

a base having two supporting bars protruding up from the base; and a transmission wheel mounted rotatably between the supporting bars;

two driving brackets connected respectively to the transmission wheel;

two handles located respectively at opposite sides of the transmission wheel, mounted pivotally on one of the supporting bars and connected pivotally and respectively to the driving brackets;

two pedal assemblies located at the opposite sides of the transmission wheels and each pedal assembly having a lever being curved and connected pivotally to one of the driving brackets; and a pedal mounted on a rear end of the lever; and an adjustment assembly mounted on a front end of the base and having two guiding rods mounted on the base;

a guiding bracket connected to the transmission wheel and mounted slidably on the guiding rods;

wherein the transmission wheel has a shaft mounted through the transmission wheel and two cranks mounted respectively and securely on two ends of the shaft and extending along opposite directions;

wherein the driving brackets are connected respectively to the cranks; and whereby the adjustment assembly allows the pedal assemblies to move along two different elliptical motion paths by moving the guiding bracket along the guiding rods to a lower position or an upper position.

2. The adjustable elliptical trainer as claimed in claim 1, wherein the adjustment assembly further has a motor mounted securely on the base;

a bolt mounted on and rotated by the motor and having an outer thread formed on the bolt; and a movable nut mounted securely on the guiding bracket, mounted movably around the bolt and having an inner threaded hole defined through the movable nut and engaging the outer thread of the bolt.

3. The adjustable elliptical trainer as claimed in claim 2, wherein the base further has a front bar mounted uprightly on the front end of the base;

an upper bracket mounted on a top end of the front bar and having two through holes defined through the upper bracket;

a lower bracket mounted on the base behind the front bar and having two mounting holes defined through the lower bracket;

the guiding rods are mounted respectively through the through holes of the upper bracket, are mounted respectively through the mounting holes of the lower bracket, and the guiding bracket has two ends and two sleeves formed on the guiding bracket and mounted slidably and respectively around the guiding rods, and each sleeve has a sleeve hole defined therethrough; and the motor is mounted securely on the upper bracket.

4. The adjustable elliptical trainer as claimed in claim 3, wherein the base further has two rail bars mounted obliquely on a rear end of the base; and each pedal assembly further has a roller slide mounted securely on the lever and mounted slidably around one of the rail bars of the base.

5. The adjustable elliptical trainer as claimed in claim 4, wherein each roller slide has multiple rollers mounted rotatably on the roller slide and rolling on the rail bar.

6. The adjustable elliptical trainer as claimed in claim 5, wherein each handle has a handlebar being longitudinal and having an intermediation section mounted pivotally on one of the supporting bars;

a top end; and a bottom end connected pivotally to a linking bar that is connected pivotally to one of the driving brackets.

* * * * *